US006577739B1

(12) United States Patent
Hurtig et al.

(10) Patent No.: US 6,577,739 B1
(45) Date of Patent: Jun. 10, 2003

(54) APPARATUS AND METHODS FOR PROPORTIONAL AUDIO COMPRESSION AND FREQUENCY SHIFTING

(75) Inventors: Richard Ray Hurtig, Iowa City, IA (US); Christopher William Turner, Coralville, IA (US)

(73) Assignee: University of Iowa Research Foundation, Iowa City, IA (US)

( * ) Notice: Subject to any disclaimer, the term of this patent is extended or adjusted under 35 U.S.C. 154(b) by 0 days.

(21) Appl. No.: 09/154,330

(22) Filed: Sep. 16, 1998

Related U.S. Application Data

(60) Provisional application No. 60/059,355, filed on Sep. 19, 1997.

(51) Int. Cl.[7] ..... H04R 25/00

(52) U.S. Cl. ..... 381/316; 381/320; 381/312; 381/106; 704/205

(58) Field of Search ..... 381/316, 150, 381/312, 317, 318, 320, 321, 106, FOR 127, FOR 129, FOR 131; 704/203, 204, 205, 500, 501, 206

(56) References Cited

U.S. PATENT DOCUMENTS

| | | | | |
|---|---|---|---|---|
| 3,385,937 A | | 5/1968 | Lafon | |
| 3,681,756 A | | 8/1972 | Burkhard et al. | 340/172.5 |
| 3,819,875 A | | 6/1974 | Velmans | 179/107 |
| 4,051,331 A | * | 9/1977 | Strong | |
| 4,188,667 A | * | 2/1980 | Graupe | |
| 4,419,544 A | * | 12/1983 | Adelman | |
| 4,464,784 A | | 8/1984 | Agnello | 381/61 |
| 4,843,623 A | * | 6/1989 | Lafon | |
| 5,029,217 A | | 7/1991 | Chabries et al. | 381/68.2 |
| 5,388,185 A | * | 2/1995 | Terry et al. | 381/320 |

FOREIGN PATENT DOCUMENTS

DE 1762185 4/1970

OTHER PUBLICATIONS

AVR Communications Ltd., "TranSonic Technical Review & Principles of Operation," Rev. 4–93, pp. 1–10.

Rion Company, Ltd., "Digital Hearing Aid: Digitalian Pal HD–11," No. 27460, pp. 1–31.

Minuzo, H. and M. Abe, Speech Communication, vol. 16, 1995, pp. 153–164.

Mazor, M., H. Simon, J. Scheinberg, and H. Levitt, "Moderate Frequency Compression for the Moderately Hearing Impaired,"0 Journal of the Acoustical Society of America, vol. 62, No. 5, 1977, 1273–1278.

Published European patent application No. 81401782.8 by Lafon, Jean–Claude, "Perfectionnements aux dispositifs de prothese auditive," filed 1981, published 1982.

* cited by examiner

*Primary Examiner*—Huyen Le
(74) *Attorney, Agent, or Firm*—Jennifer L. Bales; Macheledt Bales LLP

(57) ABSTRACT

Apparatus and methods for audio compression and frequency shifting retain the spectral shape of an audio input signal while compressing and shifting its frequency. The fast Fourier transform of the input signal is generated, to allow processing in the frequency domain. The input audio signal is divided into small time segments, and each is subjected to frequency analysis. Frequency processing includes compression and optional frequency shifting. The inverse fast Fourier transform function is performed on the compressed and frequency shifted spectrum, to compose an output audio signal, equal in duration to the original signal. The output signal is then provided to the listener with appropriate amplification to insure audible speech across the usable frequency range.

15 Claims, 4 Drawing Sheets

APPARATUS AND METHODS FOR PROPORTIONAL AUDIO COMPRESSION AND FREQUENCY SHIFTING

This application claims the benefit of U.S. Provisional Application No. 60/059,355, filed Sep. 19, 1997.

BACKGROUND OF THE INVENTION

1. Field of the Invention

The present invention relates to apparatus and methods for compressing and manipulating audio data.

2. Description of the Prior Art

For some listeners with sensorineural hearing loss in the high frequency or other frequency ranges, providing audibility of the speech signal in the frequency regions of hearing loss is not effective. These listeners are unsuccessful users of hearing aids.

It is possible to determine the specific frequency regions in which users are unable to use amplified speech, using a measurement technique known as correlational analysis.

The idea of frequency lowering speech is known, but has not thus far been successful. This is because if, in the process of frequency lowering speech, the important cues of speech recognition are transformed into a new form, recognition will be degraded or, at best, require large amounts of training for listeners to learn to use the new cues. Several types of devices such as frequency transposers and vocoders have been tried for hearing impaired listeners with little success. These devices typically shift a band of high frequencies by a fixed number of Hertz to lower frequencies using amplitude modulation techniques or the like. Often the shifted band is mixed with the original low frequency signal. This produces an unnatural speech signal which is not typically useful for hearing impaired individuals.

An example of a commercially available hearing aid which attempts to move sound signals into the frequency range that can be heard by the hearing aid wearer, to increase the wearer's comprehension of speech and other sounds, accomplishes this task by compressing the audio signal in the time domain. The TranSonic™ Model FT-40 MK II hearing aid, by AVR Communications Ltd. slows down the audio signal to lower its frequency, and then a "recirculation" circuit recycles the signal from the storage device back to the input of the storage device to mix with later signals. Other hearing aids have used correlational analysis to process different parts of the audio spectrum differently, according to linear predictive coding or the like.

Human listeners are quite accustomed to recognizing at least one type of frequency compressed speech. The variation in sizes of the vocal apparatus between various speakers and speaker types (e.g. males, females, and children) produces speech that has different frequency contents. Yet most listeners easily adapt to different talkers, and recognition is relatively unaffected. One important unifying characteristic across various individual speakers is that the ratios between the frequencies of the vocal tract resonances (formant peaks) are relatively constant. In other words, the frequency differences between speakers can be represented as proportional differences in formant peaks, whereby each frequency is shifted upward or downward by a fixed multiplicative factor. Thus, proportionally frequency lowering or compression can compress the frequency of a speech signal into the usable portion of the hearing range, while retaining recognition. Similarly, proportionally compressing the audio signal and shifting it into a higher portion of the sound spectrum can offer increased recognition to individuals with hearing deficits in lower frequency ranges.

A need remains in the art for apparatus and methods to provide an understandable audio signal to listeners who have hearing loss in particular frequency ranges, by proportionally compressing the audio signal.

SUMMARY OF THE INVENTION

It is an object of the present invention to provide an understandable audio signal to listeners who have hearing loss in particular frequency ranges by proportionally compressing the audio signal. The present invention achieves this objective by maintaining the spectral shape of the audio signal, while scaling its spectrum in the frequency domain, via frequency compression, and transposing its spectrum in the frequency domain, via frequency shifting.

DETAILED DESCRIPTION OF THE PREFERRED EMBODIMENT

Figure 1:
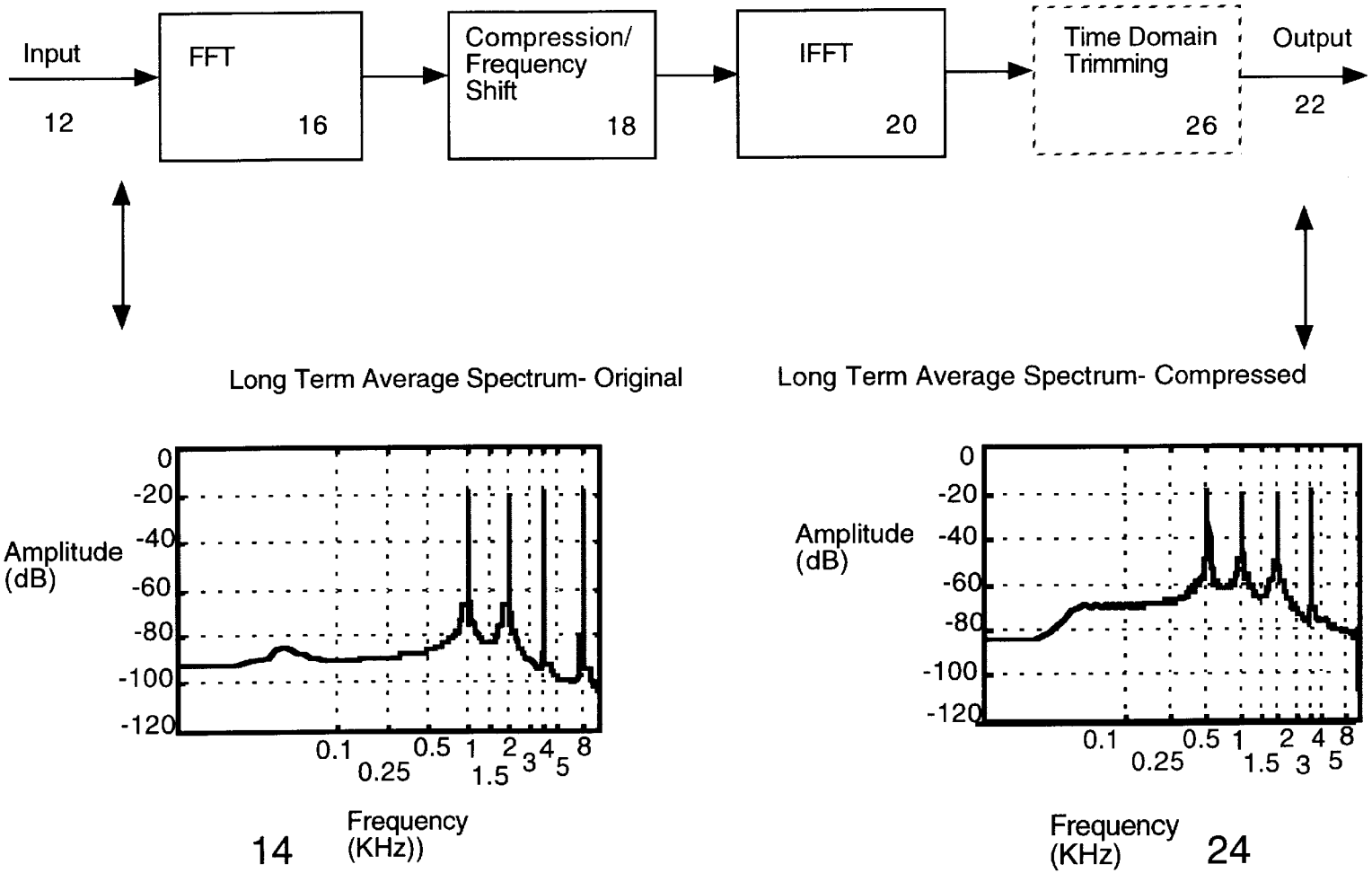
FIG. 1 shows a block diagram of the compression and frequency shifting process of the present invention.

FIG. 1 shows a block diagram of the compression and frequency shifting methods and apparatus of the present invention. The original audio signal 12 might have a spectrum like that shown in plot 14. FFT block 16 generates the fast Fourier transform of the original signal 12, to allow processing in the frequency domain. The input audio signal is divided into small time segments, and each is subjected to frequency analysis. Processing block 18 performs the scaling and transposing (or compression and frequency shifting) functions, described in more detail below. Block 20 performs the inverse fast Fourier transform function on the scaled and transposed spectrum, to compose the output audio signal 22, equal in duration to the original signal. The output signal is then provided to the listener with appropriate amplification to insure audible speech across the usable frequency range.

Plot 24 shows how the spectrum of plot 14 would be modified by the processing of FIG. 1, given a compression ratio of 50%, or compression factor of 0.5, and no additional transposition of the spectrum. This particular set of processing parameters would be useful for a listener with hearing loss in the high frequency ranges. All of the information that was located at higher frequencies has been proportionally shifted to lower frequencies, where the listener can hear it. More importantly, by proportionally shifting the spectral components the lawful relationship between spectral peaks associated with speech signals is maintained so the listener can understand the information. The particular selection of the amount of compression would be determined by the hearing loss of the user. Compression factors of 0.9, 0.8, 0.7, 0.6, and 0.5 have been accomplished in the lab. Compression factors of up to 0.99 should work well.

For a person with hearing loss in low frequency ranges, the compression might be accompanied by a frequency shift upward of, for example 100 Hz, to shift the speech spectrum into the region of usable hearing.

Figure 4:
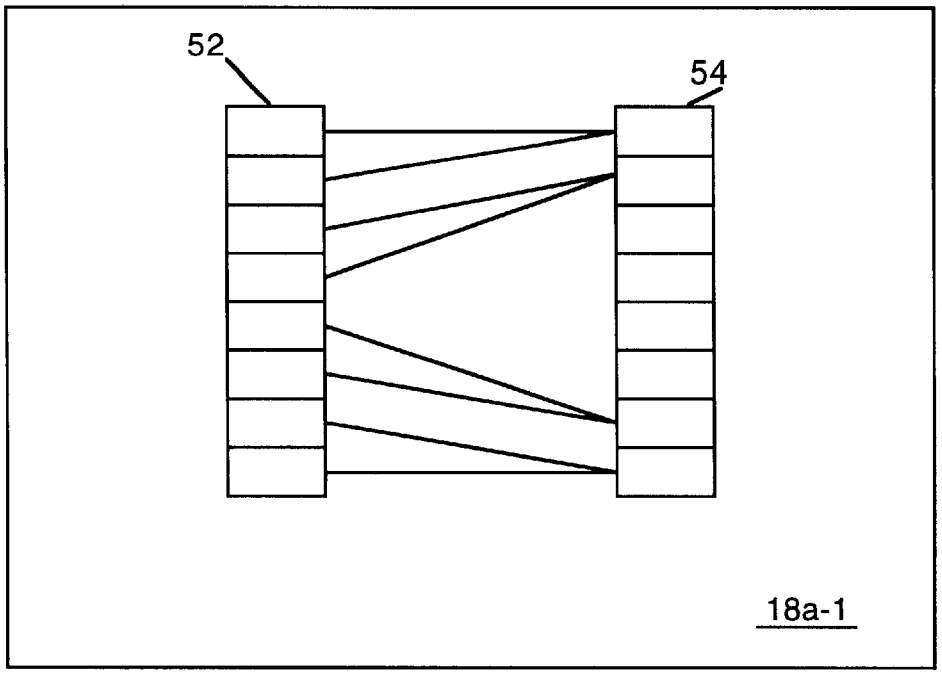
FIG. 4 illustrates in more detail how the compression step of FIG. 2 is accomplished.
Figure 5:
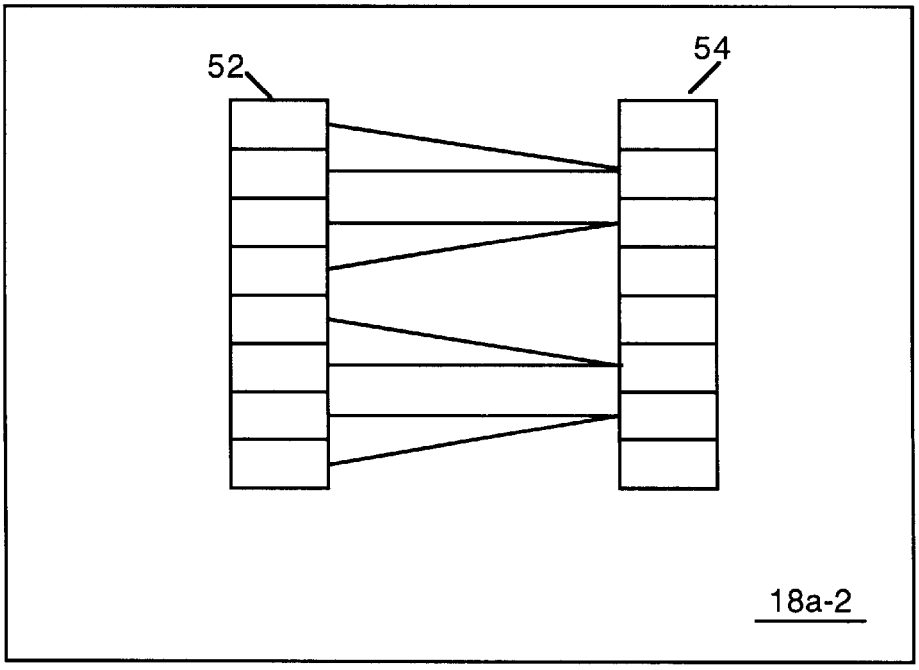
FIG. 5 illustrates in more detail how the compression step of FIG. 2 is accomplished, along with frequency shifting.
Figure 6:
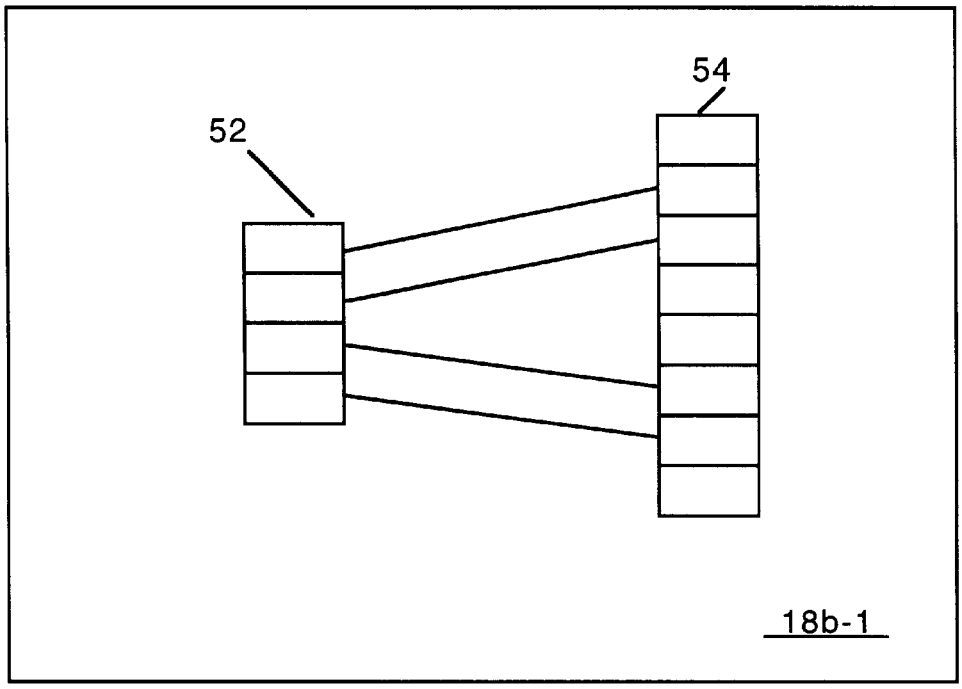
FIG. 6 illustrates in more detail how the compression step of FIG. 3 is accomplished, along with frequency shifting.
Figure 7:
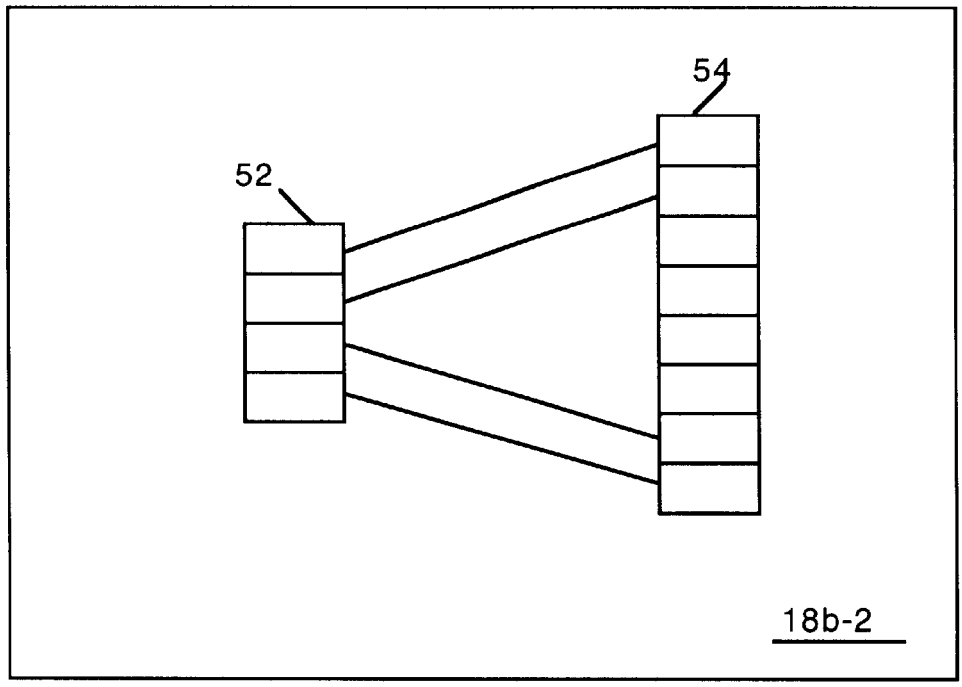
FIG. 7 illustrates in more detail how the compression step of FIG. 3 is accomplished, without frequency shifting.

A number of different methods may be used to proportionally compress the FFT data, and do the optional additional frequency shifting. FIGS. 2–7 show examples of how this may be accomplished. Note that optional block 26 indicates that the time domain signal may be trimmed to ensure that the input signal and the output signal have the same duration. This block is used as shown in FIGS. 3, 6, and 7, and described in the accompanying text below. Each compression technique will compress the frequency range of the input audio signal in order to fit within the frequency range in which the listener can utilize amplified sound. The general principle is that each frequency is shifted by the same ratio; thus preserving the relative spectral shape, one of the most important invariant cues for speech recognition across various speakers.

Figure 2:
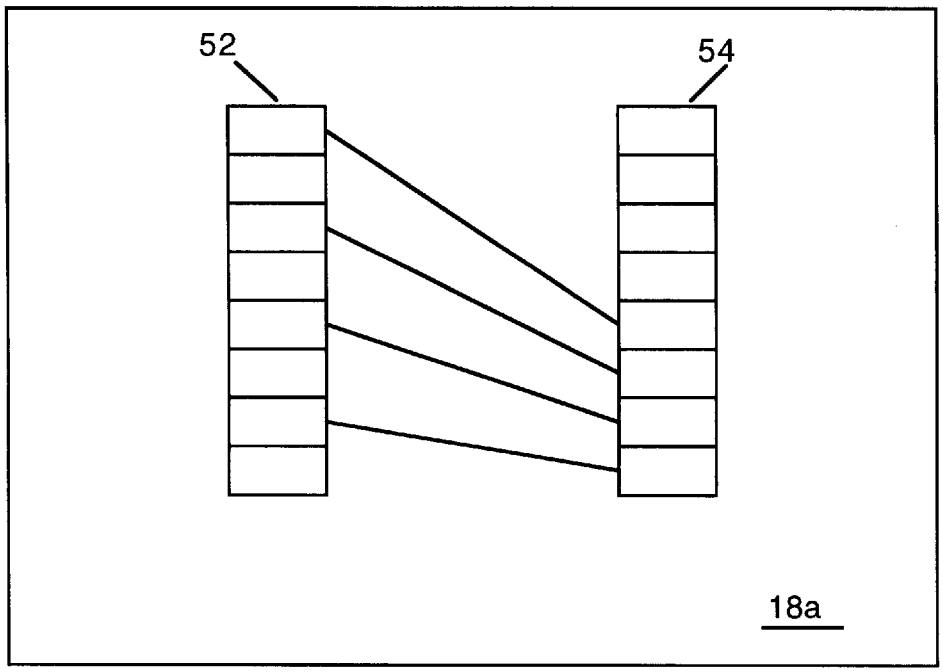
FIG. 2 illustrates a simplified block diagram illustrating a first method of proportional compression according to the present invention.
Figure 3:
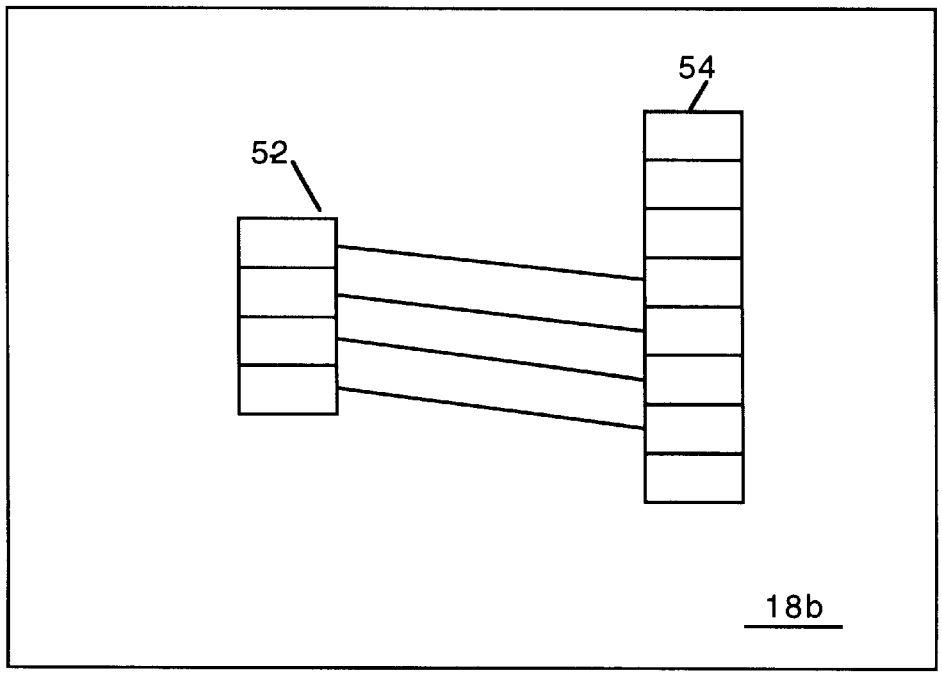
FIG. 3 illustrates a simplified block diagram illustrating a second method of proportional compression along with frequency shifting according to the present invention.

FIG. 2 illustrates a simplified block diagram 18*a* illustrating a first preferred embodiment of proportional compression step 18. FIG. 2 is simplified for clarity, showing only processing of the lower portion of the complex frequency spectrum, which is, in fact, symmetrical. The method of FIG. 2 is extremely simple. The output of FFT block 16 is a complex array 52 of data representing amplitudes at various frequencies. The compression/frequency shift algorithm 18*a* simply maps the data, preferably using linear interpolation to minimize data loss, from bins in input array 52 to a smaller number of bins in output array 54. For an input array of size 4096 and a compression ratio of 50% for example, the values associated with input array points 1 through 2048 are mapped to output array points 1 through 1024 (and likewise values above the nyquist frequency, which is located at the center of the array, are mapped to output array 3072 to 4096 as shown in FIG. 4). If a compression factor of 0.67 were desired, linear interpolation between the values of approximately three input array bins provide values for two output array bins. Obviously, some frequency resolution is lost in this mapping, as would be expected in fitting the audio input data into a smaller output spectrum.

If the spectrum is to be frequency shifted in addition to the proportional compression, this is accounted for in the same mapping step. If the data is to be frequency shifted up by 100 Hz, for example, and 100 Hz corresponds to point 47 in the output array, then input array points are mapped between points 47 and 4049 (FIG. 5 shows the compression and frequency shifting process in detail).

FIG. 3 is a simplified block diagram 18*b* illustrating a second method of proportional compression 18 along with frequency shifting according to the present invention. Again, FIG. 3 is simplified for clarity, showing only processing of the lower portion of the complex frequency spectrum, which is, in fact, symmetrical. In the method of FIG. 3, input array 52 (which is the result of FFT operation 16) is padded with zeroes, preferably inserted in the center of the array, around the nyquist, and mapped onto output array 54 as shown. Output array 54 is twice as large as input array 52, for 50% compression (the size of the pad determines the amount of compression). FIGS. 6 and 7 show in more detail the method by which the zero pad is added to the complex array generated by FFT step 16.

After IFFT 20 is performed, output (time domain) data 22 is trimmed to the size of the original input signal 12 (block 26 of FIG. 1), so that output signal 22 has the same duration as input signal 12. This trimming may be accomplished in a number of ways. For example, points may be trimmed off the beginning of the array, the middle of the array, or the end of the array (or any combination of the forgoing). The particular scheme is chosen to give the most comprehensible output signal for the listener.

FIG. 4 illustrates in more detail how the compression step 18*a* of FIG. 2 is accomplished for an example of 50% compression (step 18*a*-1). Note that adjacent frequency bins from array 52 are linearly interpolated and placed into the bins at the ends of array 54, away from the nyquist frequency at the center of the arrays.

FIG. 5 illustrates in more detail how the compression step 18*a* of FIG. 2 is accomplished, along with frequency shifting, for an example of 50% compression (step 18*a*-2). As in the process of FIG. 4, adjacent frequency bins from array 52 are linearly interpolated and placed into the bins at the ends of array 54, but the bins in which they are placed are shifted toward the center enough to accomplish the desired frequency shift. For example, if the data is to be frequency shifted up by 100 Hz, for example, and 100 Hz corresponds to point 47 in the output array, then input array points are mapped between points 47 and 4049.

FIG. 6 illustrates in more detail how the compression step 18*b* of FIG. 3 is accomplished, along with frequency shifting for an example of 50% compression (step 18*b*-1). In the particular example of FIG. 6, frequency shifting (by one point, for simplicity) is shown in addition to a compression of 50%. FIG. 7 illustrates in more detail how compression step 18*b* of FIG. 3 is accomplished, without frequency shifting, for an example of 50% compression or scaling (step 18*b*-2). Since no frequency transposing is to be done, data from the bins of input array 52 are mapped into the endmost bin of output array 54.

While the exemplary preferred embodiments of the present invention are described herein with particularity, those skilled in the art will appreciate various changes, additions, and applications other than those specifically mentioned, which are within the spirit of this invention.

What is claimed is:

1. A hearing aid for proportionally compressing a signal representing an input audio signal to a usable portion of the sound spectrum in the frequency domain, said hearing aid comprising:

a fast Fourier transform (FFT) block, for forming the FFT of the input signal;

a scaling block, for proportionally compressing the FFT of the input signal into the usable portion of the sound spectrum; and an inverse fast Fourier transform (IFFT) block, for taking the IFFT of the compressed FFT of the input signal and providing it as an output signal.

2. The hearing aid of claim 1, wherein:

the FFT block includes an input array of frequency bins, and said FFT block divides the FFT of the input signal into said input array of frequency bins; and the scaling block includes an output array of frequency bins, and said scaling block maps the data from the input array bins into a smaller number of output array bins to form the scaled FFT signal, the ratio between mapped output array bins and input array bins determining the amount of scaling accomplished.

3. The hearing aid of claim 2, wherein the amount of scaling accomplished is between about 0.5 and 0.99 compression factor.

4. The hearing aid of claim 2, wherein the scaling block further accomplishes frequency shifting by mapping the data from the input array bins to shifted output array bins according to an amount of frequency shifting desired.

5. The hearing aid of claim 4, wherein the amount of scaling accomplished is between about 0.5 and 0.99 compression factor.

6. The hearing aid of claim 4, wherein the frequency shifting accomplished is approximately 100 Hz.

7. The hearing aid of claim 1, wherein:

the FFT block includes an input array of frequency bins and divides the FFT of the input signal into said input array of frequency bins;

the scaling block includes an output array of frequency bins, said output array being larger than said input array according to a desired amount of compression, and said scaling block maps the data from the input array bins into output array bins to form the scaled FFT of the input signal; and said hearing aid further includes a trimming block for trimming the output signal in the time domain.

8. The hearing aid of claim 7, wherein the amount of scaling accomplished is between about 0.5 and 0.99 compression factor.

9. The hearing aid of claim 7, wherein the scaling block further accomplishes frequency shifting by mapping the data from the input array bins to shifted output array bins according to an amount of frequency shifting desired.

10. The hearing aid of claim 9, wherein the amount of scaling accomplished is between about 0.5 and 0.99 compression factor.

11. The hearing aid of claim 9, wherein the frequency shifting accomplished is approximately 100 Hz.

12. A hearing aid for proportionally compressing and frequency shifting a signal representing an input audio signal to a usable portion of the sound spectrum in the frequency domain, said hearing aid comprising:

a fast. Fourier transform (FFT) block, for forming the FFT of the input signal;

a scaling block, for proportionally compressing and frequency shifting the FFT of the input signal into the usable portion of the sound spectrum; and an inverse fast Fourier transform (IFFT) block, for taking the IFFT of the scaled FFT of the input signal and providing it as an output signal.

13. The hearing aid of claim 12, wherein:

the FFT block includes an input array of frequency bins, and said FFT block divides the FFT of the input signal into said input array of frequency bins; and the scaling block includes an output array of frequency bins, and said scaling block maps the data from the input array bins into a smaller number of output array bins to form the scaled FFT signal, the ratio between mapped output array bins and input array bins determining the amount of scaling accomplished, and wherein the scaling block accomplishes frequency shifting by mapping the data from the input array bins to shifted output array bins according to an amount of frequency shifting desired.

14. The hearing aid of claim 13, wherein the amount of scaling accomplished is between about 0.5 and 0.99 compression factor.

15. The hearing aid of claim 13, wherein the frequency shifting accomplished is approximately 100 Hz.

* * * * *

UNITED STATES PATENT AND TRADEMARK OFFICE

CERTIFICATE OF CORRECTION

PATENT NO. : 6,577,739 B1
DATED : June 10, 2003
INVENTOR(S) : Richard Ray Hurtig and Christopher William Turner It is certified that error appears in the above-identified patent and that said Letters Patent is hereby corrected as shown below:

Column 1,
After line 6, insert -- This invention was made with government support under grant 2R01 DC 00377-12 awarded by the National Institutes of Health. The government has certain rights in the invention. --

Signed and Sealed this

Ninth Day of August, 2005

JON W. DUDAS
*Director of the United States Patent and Trademark Office*